United States Patent [19]

Normanton

[11] 4,358,314

[45] Nov. 9, 1982

[54] METAL REFINING PROCESS

[75] Inventor: Adrain S. Normanton, Middlesbrough, England

[73] Assignee: British Steel Corporation, London, England

[21] Appl. No.: 293,508

[22] Filed: Aug. 17, 1981

[30] Foreign Application Priority Data

Sep. 3, 1980 [GB] United Kingdom ..... 8028485

[51] Int. Cl.[3] ..... C21C 5/32; C21C 5/34

[52] U.S. Cl. ..... 75/60; 75/51; 75/52; 75/59

[58] Field of Search ..... 75/60, 59, 51, 52

[56] References Cited

U.S. PATENT DOCUMENTS 3,854,932 12/1974 Bishop ..... 75/60
4,089,677 5/1978 Spenceley ..... 75/60
4,178,173 12/1979 Gorges ..... 75/60
4,195,985 4/1980 Bratzmann ..... 75/60
4,280,838 7/1981 Marnkawa ..... 75/60
4,302,244 11/1981 Sieckman ..... 75/60

*Primary Examiner*—P. D. Rosenberg
*Attorney, Agent, or Firm*—Bacon & Thomas

[57] ABSTRACT

A process for refining steel by top blowing with below melt tuyere injection in which at the commencement of the refining cycle the refining gas lance is located at a pre-determined height above the melt, and the gas flow rate to the below melt tuyere or tuyeres is set at a predetermined level, comprising the steps of reducing the height of the lance and the gas flow rate to the tuyeres in one or more stages during the course of the refining cycle and increasing the height of the lance and the gas flow rate to the tuyeres towards the end of the refining cycle.

18 Claims, 2 Drawing Figures

METAL REFINING PROCESS

Figure 1:
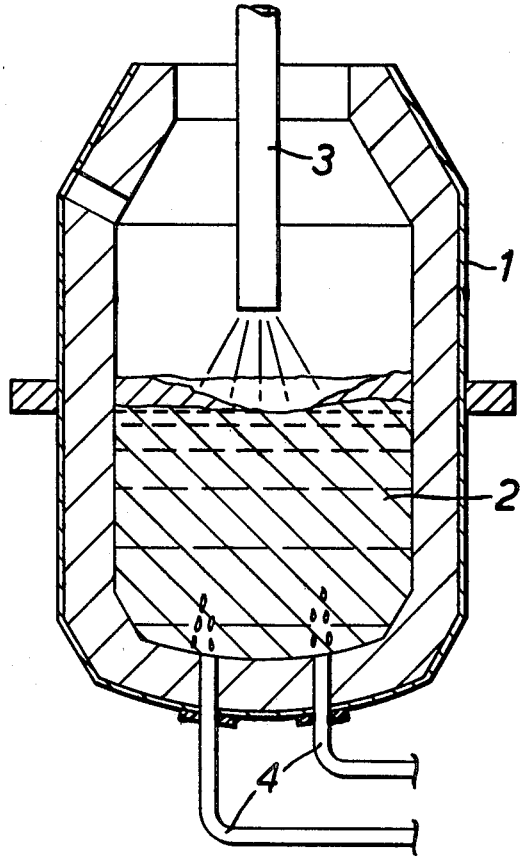

This invention relates to a process for refining metal and more particularly to a steel refining process of the kind including a refining cycle during which a refining gas, such as oxygen, is blown on to the upper surface of a melt contained in a refining vessel by means of an overhead lance, and additionally a stirring or processing gas, sometimes together with entrained solid reactants in powder or granular form, is injected directly into the melt by means of one or more tuyeres projecting through the wall of the vessel below the level of the melt therein.

According to the invention there is provided a process for refining steel of the kind comprising blowing a refining gas onto the upper surface of a melt contained in a refining vessel by means of an overhead lance, and additionally injecting a stirring or processing gas directly into the melt by means of one or more tuyeres projecting into the melt below the surface thereof, in which at the commencement of the refining cycle the refining gas lance is located at a predetermined height above the melt, and the gas flow rate to the below melt tuyere or tuyeres is set at a predetermined level, including the steps of reducing the height of the lance and the gas flow rate to the tuyeres in one or more stages during the course of the refining cycle, and increasing the height of the lance and the gas flow rate to the tuyeres towards the end of the refining cycle.

The lance may be lowered in height from its initial position in a number of stages and may similarly be increased towards the end of the refining cycle over a number of stages. The lance height may in some instances be returned to its initial level by the end of the refining cycle.

Similarly the gas flow rates to the tuyere or tuyeres may be reduced by a number of stages and then increased by a number of stages. Again, the final gas flow rate may be the same as the initial gas flow rate.

We have found in practice that the combination of process steps herein defined has a surprisingly beneficial effect upon the quality of steel produced during refining, Thus a relatively high early gas flow rate to the tuyere or tuyeres provides a high initial stirring rate within the melt which prevents excessive slag oxidation (during a period when the lance is at a relatively high level for the purpose of slag fluxing) and promotes decarburisation. With the lowering of the lance and the increase in the rate of decarburisation to a maximum during what can generally be called the middle part of the refining cycle, significant bath stirring from lance gas reaction occurs and gas injection rates can be reduced to a level appropriate to provide circulation deep within the melt. Later in the refining cycle as the lance is raised, for final refining purposes, and the rate of decarburisation commences to fall, increase in gas flow in the tuyeres to provide an increased internal stirring permits final carbon removal and ensures a minimum build-up of slag iron oxides.

It will be appreciated that the specific lance heights and gas flow rates to the tuyeres will vary depending upon the composition of the input metal and the refining vessel, and the quantity and quality of scrap and other additives such as lime; and will also vary in dependence on the steel to be produced, the size of the converter, the nature of the refining lance and the form and number of injection tuyeres.

Figure 2:
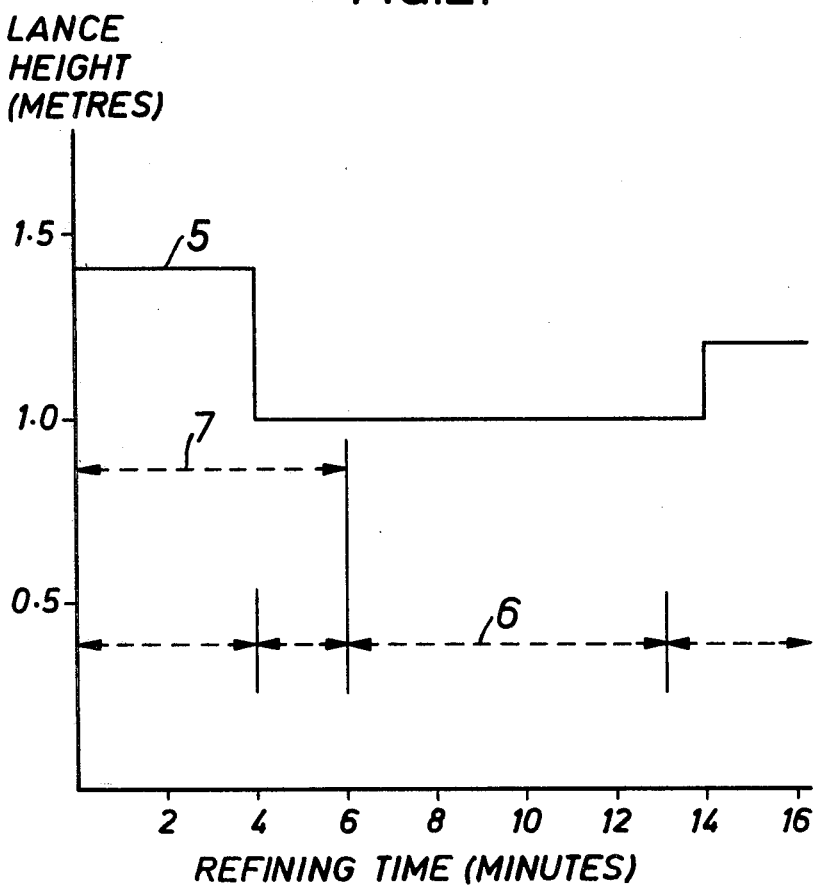

One example of the invention will now be described by way of example with reference to the accompanying drawings in which:

FIG. 1 is a schematic elevation of plant for carrying out the process of the invention; and FIG. 2 is an illustration in tabular form of the relationship between lance height and injection gas flow rate in a refining process of the invention.

In the particular embodiment illustrated, a 16 minute refining cycle was utilised for a nominal 140 tonne converter vessel 1, the input material comprising blast furnace metal 2 incorporating approximately 1% silicon.

It is to be noted that a three orifice overhead oxygen lance 3 having a blowing rate of approximately 16,000 cubic feet per minute was used.

At the same time, two double concentric tube tuyeres 4 were used to inject stirring gas comprising air sheathed by an inert gas into the vessel.

It will be observed from FIG. 2 that the lance height (indicated by line 5) at the commencement of refining was just over 1.4 m above the melt surface and the total input gas flow (indicated by line 6) rate was initially 12,000 $m^3/h$. After 4 min the lance height was reduced to 1 m and the total gas flow rate to 1,000 $m^3/h$. Lime additions (as shown by line 7) were made to the melt for this first 6 min of the refining cycle at the end of which the total gas flow rate was reduced to 800 $m^3/h$. After 13 min, and approaching the end of the refining cycle, the gas flow rate was increased to 1,000 $m^3/h$, and after 14 min the lance height was increased to approximately 1.2 m.

The combination of lance movements and injection gas flow variations was found to be particularly and surprisingly effective in the production of a refined steel.

Two further examples of the operation of the embodiment of the invention illustrated will now be described.

The first example is the production of silicon-killed boron grade steel having an initial melt composition including 4.6% carbon, 0.89% manganese, 0.11% phosphorus, 0.16% sulphur and 1.8% silicon. The refining cycle took 14.7 minutes. 15.7 tonnes of lime were added during the first 5 minutes of the cyle. The lance outlet was initially 1.8 m above the melt. It was reduced to 1.4 m after 3 minutes and 1.1 m after 7.2 minutes. After 14 minutes the lance was raised to 1.8 m. The total tuyere gas flow rate commenced at 1000 $m^3$/hour (to achieve rapid silicon removal), was reduced to 650 $m^3$/hour after two minutes, and then increased to 800 $m^3$/hour after 14 minutes. The final steel composition included 0.14% carbon, 0.42% Manganese, 0.017% Phosphorus and 0.12% Sulphur.

The second example is the production of a balanced grade steel having an initial melt composition including 4.5% carbon, 0.80% Manganese, 0.1% Phosphorus, 0.026% Sulphur and 0.97% Silicon. The refining cycle took 15.5 minutes. 11.4 tonnes of lime were added during the first 5.3 minutes of the cycle. The lance outlet was initially 1.9 m above the melt. It was reduced to 1.5 m after 4.5 minutes and 1.1 m after 5.2 minutes After 14.5 minutes the lance was raised to 1.5 m. The total tuyere gas flow rate commenced at 850 $m^3$/hour, was reduced to 650 $m^3$/hour after ten minutes, and then increased to 850 $m^3$hour after 14 minutes. The final steel composition includes 0.075% Carbon, 0.30% Manganese, 0.005% Phosphorus and 0.015% Sulphur.

I claim:

1. In a process for refining steel comprising blowing a refining gas on to the upper surface of a melt contained in a refining vessel by means of an overhead lance, and additionally injecting a stirring or processing gas directly into the melt by means of one or more tuyeres projecting into the melt below the surface thereof, the improvement in which at the commencement of the refining cycle the refining gas lance is located at a predetermined height above the melt, and the gas flow rate to the below melt tuyere or tuyeres is set at a predetermined level, and further characterised by the steps of reducing the height of the lance and the gas flow rate to the one or more tuyeres in one or more stages during the course of the refining cycle, and increasing the height of the lance and the gas flow rate to the tuyere or tuyeres towards the end of the refining cycle.

2. A process as claimed in claim 1 characterised in that the lance is lowered in height from its initial position in a plurality of stages.

3. A process as claimed in claim 1 or 2 characterised in that the height of the lance is increased towards the end of the refining cycle by a single stage.

4. A process as claimed in claim 1 or 2 characterised in that the lance is returned to its initial level by the end of the refining cycle.

5. A process as claimed in claim 1 or 2 characterised in that the gas flow rate to the tuyere or tuyeres is reduced by a single stage.

6. A process as claimed in claim 1 or 2 characterised in that the gas flow rate to the tuyere or tuyeres is increased towards the end of the refining cycle by a single stage.

7. A process as claimed in claim 1 or 2 for refining a ferrous melt of between 130 to 160 tonnes characterised in that the lance outlet height is initially at between 1.5 m and 2.0 m above the melt, is subsequently reduced to between 1.0 m and 1.5 m during the refining cycle, and is then increased to between 1.5 m and 2.0 m towards the end of the refining cycle.

8. A process as defined in claim 7 characterised in that the gas flow rate to the tuyere or tuyeres is initially between 700 $m^3/h$ and 1000 $m^3/h$, is subsequently reduced to between 500 $m^3/h$ and 700 $m^3/h$ during the refining cycle, and is then increased to between 700 $m^3/h$ and 1000 $m^3/h$ towards the end of the refining cycle.

9. A process as claimed in claim 3 characterised in that the lance is returned to its initial level by the end of the refining cycle.

10. A process as claimed in claim 3 characterised in that the gas flow rate to the tuyere or tuyeres is reduced by a single stage.

11. A process as claimed in claim 4 characterised in that the gas flow rate to the tuyere or tuyeres is reduced by a single stage.

12. A process as claimed in claim 3 characterised in that the gas flow rate to the tuyere or tuyeres is increased toward the end of the refining cycle by a single stage.

13. A process as claimed in claim 4 characterised in that the gas flow rate to the tuyere or tuyeres is increased toward the end of the refining cycle by a single stage.

14. A process as claimed in claim 5 characterised in that the gas flow rate to the tuyere or tuyeres is increased toward the end of the refining cycle by a single stage.

15. A process as claimed in claim 3 for refining a ferrous melt of between 130 to 160 tonnes characterised in that the lance outlet height is initially at between 1.5 m and 2.0 m above the melt, is subsequently reduced to between 1.0 m and 1.5 m during the refining cycle, and is then increased to between 1.5 m and 2.0 towards the end of the refining cycle.

16. A process as claimed in claim 4 for refining a ferrous melt of between 130 to 160 tonnes characterised in that the lance outlet height is initially at between 1.5 m and 2.0 m above the melt, is subsequently reduced to between 1.0 m and 1.5 m during the refining cycle, and is then increased to between 1.5 m and 2.0 m towards the end of the refining cycle.

17. A process as claimed in claim 5 for refining a ferrous melt of between 130 to 160 tonnes characterised in that the lance outlet height is initially at between 1.5 m and 2.0 m above the melt, is subsequently reduced to between 1.0 m and 1.5 m during the refining cycle, and is then increased to between 1.5 m and 2.0 m towards the end of the refining cycle.

18. A process as claimed in claim 6 for refining a ferrous melt of between 130 to 160 tonnes characterised in that the lance outlet height is initially at between 1.5 m and 2.0 m above the melt, is subsequently reduced to between 1.0 m and 1.5 m during the refining cycle, and is then increased to between 1.5 m and 2.0 m towards the end of the refining cycle.

* * * * *